US006725482B2

(12) United States Patent
George, II

(10) Patent No.: US 6,725,482 B2
(45) **Date of Patent: *Apr. 27, 2004**

(54) FRAMELESS CHAIR

(75) Inventor: Daniel C. George, II, Grand Rapids, MI (US)

(73) Assignee: Comfort Research, LLC, Grand Rapids, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/941,064

(22) Filed: Aug. 28, 2001

(65) Prior Publication Data

US 2002/0023299 A1 Feb. 28, 2002

Related U.S. Application Data

(63) Continuation of application No. 09/372,369, filed on Aug. 11, 1999, now Pat. No. 6,279,184.

(51) Int. Cl.[7] ..... A47C 23/00
(52) U.S. Cl. ..... 5/652; 5/655.9; 297/462
(58) Field of Search ..... 5/652, 653, 655.9, 5/630, 641, 95.3, 718, 740; 297/219.1, 214, 461, 462

(56) References Cited

U.S. PATENT DOCUMENTS 4,184,237 A * 1/1980 Blankenship ..... 29/451
D355,077 S * 2/1995 Tegner ..... 5/653
5,566,953 A * 10/1996 Arriola et al. ..... 273/115
D384,211 S * 9/1997 Wied et al. ..... D6/349
6,141,807 A * 11/2000 Tapper ..... 5/653

* cited by examiner

*Primary Examiner*—Teri Pham Luu
*Assistant Examiner*—Fredrick Conley
(74) *Attorney, Agent, or Firm*—King & Jovanovic, PLC

(57) ABSTRACT

A substantially spherical frameless chair comprising an at least partially gas permeable outer liner, an at least partially gas permeable inner liner positioned inside of the outer liner, and a plurality of polyurethane foam pieces having a density between approximately 1.0 and approximately 3.0 pounds per cubic foot retained within the inner liner. The outer liner includes a first end component having a substantially circular peripheral geometry, a second end component having a substantially circular peripheral geometry, and an intermediate component having a substantially rectangular peripherical geometry wherein the first and second end components are secured to the intermediate component to, in turn, form a substantially spherical outer liner. The inner liner includes a first end component having a substantially circular peripheral geometry, a second end component having a substantially circular peripheral geometry, and an intermediate component having a substantially rectangular peripherical geometry, wherein the first and second end components are secured to the intermediate component to, in turn, form a substantially spherical inner liner.

3 Claims, 2 Drawing Sheets

FRAMELESS CHAIR

CROSS-REFERENCE TO RELATED APPLICATION(S)

This application is a continuation application of U.S. application Ser. No. 09/372,369 filed on Aug. 11, 1999 now U.S. Pat. No. 6,279,184, the entirety of which is hereby incorporated herein by reference.

BACKGROUND OF THE INVENTION

1. Field of the invention

The present invention relates in general to frameless chairs, and more particularly, to a frameless chair having a structural configuration which, among other things, increases longevity, durability, washability, and shapability of the same.

2. Background Art

Frameless chairs have been known in the art for several years. Furthermore, frameless chairs filled with beads of polystyrene foam have likewise been known in the art. While such conventional frameless chairs have become popular, their shapability and durability, among other things, remains problematic. In particular, after a conventional frameless chair has been occupied by a person, the beads of polystyrene foam that are held within the liner of the chair remain substantially compressed resulting in a chair having depression where person was sitting. The depression remains in the chair unless and until a person reshapes the chair by exerting physical force upon it—such as by rolling, shaking, or fluffing the chair.

A second problem associated with conventional frameless chairs is that once the outer liner of the chair has been worn through by normal wear and tear or otherwise damaged by accidental puncturing, the beads of polystyrene foam are readily released from the chair and, in turn, can endanger, for example, small children and/or animals. Moreover, inasmuch as conventional chairs have only one liner, washing such a liner is extremely difficult because the numerous beads of polystyrene foam must first be removed before the liner can be machine washed. In addition, conventional frameless chairs have material and stitching patterns that are not conducive to promoting chair longevity. Specifically, for example, the stitching used in conventional frameless chairs is externally exposed making it vulnerable to "catching" and/or "snagging" by an occupant.

SUMMARY OF THE INVENTION

The present invention is directed to a substantially spherical frameless chair comprising: 1) an outer liner comprising: a) a first end component having a substantially circular peripheral geometry; b) a second end component having a substantially circular peripheral geometry; c) an intermediate component having a substantially rectangular peripheral geometry; said first and second end components being secured to said intermediate component to, in turn, form a substantially spherical outer liner; 2) an inner liner positioned inside of said substantially spherical outer liner comprising: a) a first end component having a substantially circular peripheral geometry; b) a second end component having a substantially circular peripheral geometry; c) an intermediate component having a substantially rectangular peripherical geometry, said first and second end components being secured to said intermediate component to, in turn, form a substantially spherical inner liner; and 3) a plurality of polyurethane foam pieces retained within said substantially spherical inner liner having a density between approximately 1.0 and approximately 3.0 pounds per cubic foot.

In a preferred embodiment of the invention, the density of the polyurethane foam ranges from between approximately 1.3 and approximately 1.8 pounds per cubit foot.

In yet another preferred embodiment of the invention, the outer liner includes a zipper associated with at least one of the first end component, the second end component, and the intermediate component of the outer liner. In this embodiment the zipper is preferably treated with an adhesive material.

In another preferred embodiment of the invention, the inner liner includes a zipper associated with at least one of the first end component, the second end component, and the intermediate component of the inner liner. In this embodiment the zipper is preferably treated with an adhesive material.

In preferred embodiments the of the invention, the outer liner and the inner liner are fabricated from a machine washable material.

In yet another preferred embodiment of the invention, the plurality of polyurethane foam pieces are treated with a substantially water impermeable agent.

In other preferred embodiments of the invention, the outer liner and the inner liner are treated with a substantially water impermeable agent.

Preferably, the outer liner includes at least one seem having an outer surface and an inner surface, said outer surface of seem being void of any exposed stitching.

In an additional preferred embodiment of the invention, at least one of the plurality of polyurethane foam pieces is impregnated with an organic ester.

The present invention is also directed to a substantially spherical frameless chair comprising: an outer liner and means for releasing an odoriferous agent from said chair, wherein the odoriferous agent releasing means comprises at least one of the plurality of polyurethane foam pieces being impregnated with at least one organic ester retained within the inner liner.

The present invention is further directed to a substantially spherical frameless chair comprising: 1) an at least partially gas permeable outer liner comprising: a) a first end component having a substantially circular peripheral geometry; b) a second end component having a substantially circular peripheral geometry; c) an intermediate component having a substantially rectangular peripheral geometry, said first and second end components being secured to said intermediate component to, in turn, form a substantially spherical outer liner wherein the outer liner includes at least one seem having an outer surface and an inner surface, said outer surface being void of any exposed stitching; and 2) a plurality of polyurethane foam pieces having a density between approximately 1.0 and approximately 3.0 pounds per cubic foot retained within said outer liner.

BRIEF DESCRIPTION OF THE DRAWINGS

The invention will now be described with reference to the drawings wherein.

DETAILED DESCRIPTION OF THE DRAWINGS

Figure 1:
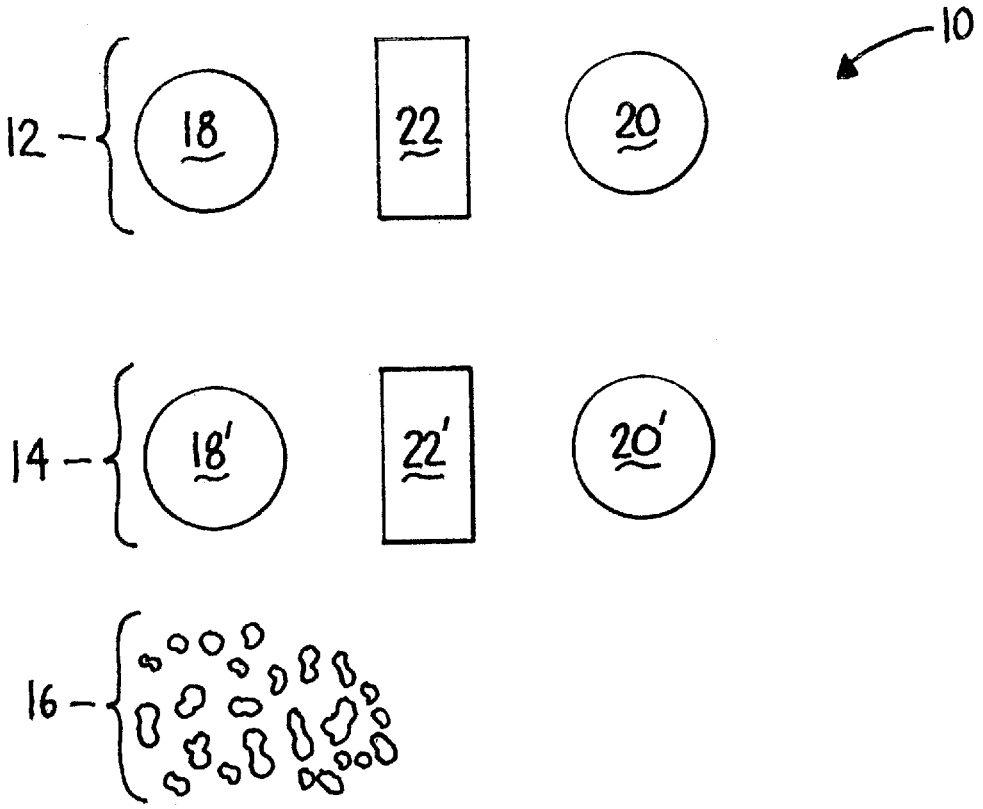
FIG. 1 of the drawings is a schematic representation of an unassembled frameless chair according to the present invention.

While this invention is susceptible of embodiment in many different forms, there is shown in the drawings and will herein be described in detail several specific embodiments with the understanding that the present disclosure is to be considered as an exemplification of the principles of the invention and is not intended to limit the invention to the embodiments illustrated.

Frameless chair 10 is shown in FIG. 1, prior to assembly, as generally comprising outer liner 12, inner liner 14, and a plurality of polyurethane foam pieces 16.

Outer liner 12 includes first end component 18, second end component 20, and intermediate component 22. First and second end components 18 and 20 have a substantially circular peripheral geometry and intermediate component 22 has a substantially rectangular peripheral geometry. Upon assembly of outer liner 12, first and second end components 18 and 20 and intermediate component 22 are fused together, preferably by sewing. However, any one of a number of fusing techniques known to those having ordinary skill in the art are likewise contemplated for use.

Figure 2:
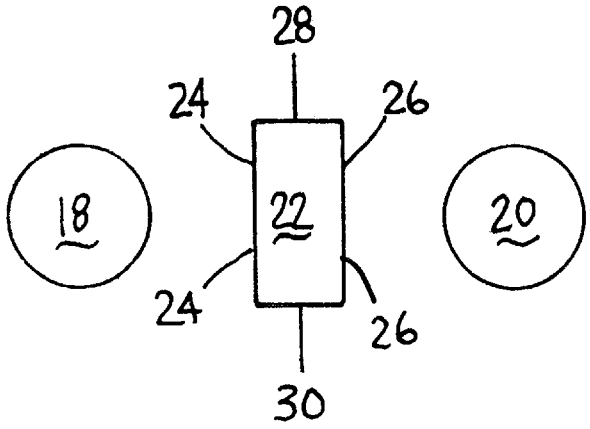
FIG. 2 of the drawings is a schematic representation of an unassembled outer liner showing the adjoining edges of the component parts according to the present invention.
Figure 3:
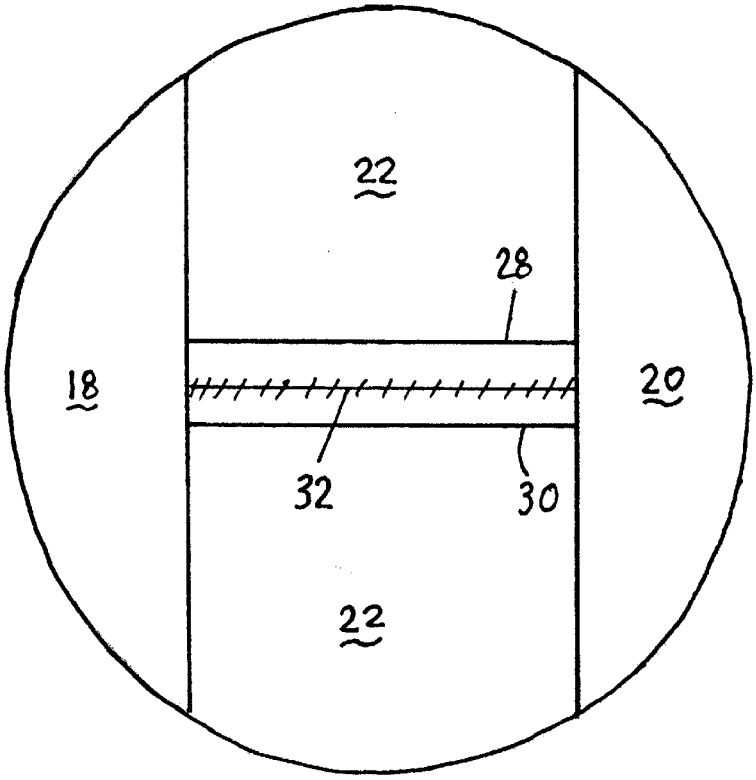
FIG. 3 of the drawings is a schematic representation of an assembled outer liner showing the placement of a zipper according to the present invention.

As best shown in FIG. 2, the peripheral edge of end component 18 is fused to edge 24 of intermediate component 22 and the peripheral edge of end component 20 is fused to edge 26 of intermediate component 22. Edges 28 and 30 of intermediate component 22 are sewn together to, in turn, form a three piece substantially spherical outer liner. The formation of three piece substantially spherical outer liner 12 is highly preferred because conventional configurations used in the art utilize more complex cutting and stitching patterns. The configuration of the present invention is simple to cut (or even stamp) and stitch making it highly desirous. As shown in FIG. 3, zipper 32 is preferably fused between edges 28 and 30. However, it is also contemplated that zipper 32 can be associated with either first and/or second end components 18 and 20, respectively. In addition, zipper 32 can be treated with an adhesive to enhance the lockability of zipper and, in turn, substantially prevent zipper 32 from opening inadvertently.

Figure 4:
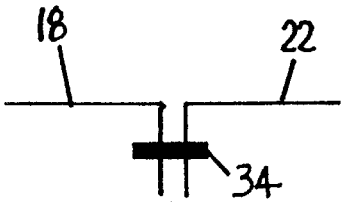
FIG. 4 of the drawings is a fragmented cross sectional schematic representation of an outer liner showing a stitch location according to the present invention.
Figure 5:
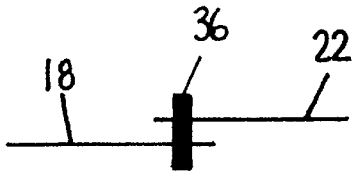
FIG. 5 PRIOR ART
FIG. 5 of the drawings is a fragmented cross sectional schematic representation of a prior art outer liner showing the stitch location.

Components 18, 20, and 22 of outer liner 12 are preferably sewn together so that the external seems are void of exposed stitching. The avoidance of exposed stitching is best shown in FIG. 4 and accomplished by, for example, mating components 18 and 22 without overlapping the material and sewing at least one stitch at point 34. As shown in FIG. 5, if components 18 and 22 are conventionally overlapped and sewn at point 36, a stitch is exposed to the outer surface of outer liner 12, which is vulnerable to catching or snagging. Components 18, 20 and 22 of outer liner 12 are preferably fabricated from a machine washable material that is at least partially gas permeable—so as to allow air to enter and exit the liner when an occupant sits in or departs from the chair.

Referring again to FIG. 1, inner liner 14 includes first end component 18', second end component 20', and intermediate component 22'. First and second end components 18' and 20' have substantially circular peripheral geometry and intermediate component 22' has a substantially rectangular peripheral geometry. First and second end components 18' and 20' and intermediate component 22' are adjoined together, preferably by sewing, in an analogous manner as previously described relative to outer liner 12 to form a substantially spherical inner liner. Preferably zipper 32' is associated with either one or both of first and second end components 18' and 20', respectively. Components 18', 20' and 22' of inner liner 14 are preferably fabricated from a machine washable material that is at least partially gas permeable.

Once inner liner 14 is fabricated, a plurality of polyurethane pieces 16 are inserted into inner liner 14 to, in turn, fill out the substantially spherical space. Inner liner 14 is then fitted into outer liner 12 to complete assembly. It will be understood that frameless chair 10 can be fabricated without inner liner 14. In such as case, polyurethane foam pieces 16 are inserted directly into the outer liner.

Commercially available polyurethane foam pieces 16 replace conventional inexpensive polystyrene beads because the polystyrene beads are not resiliently compressible. As such, the polystyrene beads are void of any inherent ability to fill out an inner liner back to its original shape after an occupant departs from the chair. Certain species of polyurethane foam, on the other hand, are both compressible and resilient. In particular, it has been found that polyurethane having a density between 1.0 and 3.0 pounds per cubic foot is sufficiently compressible to conform to an occupant's bodily dimensions and sufficiently resilient to fill out the chair one the occupant departs from the same. Moreover, it has been further determined that polyurethane foam having a density of 1.3 to 1.8 pounds per cubic foot is highly desired because it offers the desired resiliency without added weight—an important characteristic for shipping mass quantities of chairs having such polyurethane foam.

Foam pieces 16 can also be impregnated with an organic ester. Impregnation of an organic ester serves at least two purposes. First, the odor of commercially available polyurethane may be initially undesirable to certain humans and/or pets. As such, the organic ester can neutralize the undesired odor with a nominal amount—i.e. a very light spray is sufficient with most esters. Second, due to the relatively amorphous characteristics of the polyurethane foam, the foam can readily adsorb household odors that can be neutralized with such an organic ester. Any one of a number of commercially available (Aldrich Chemical Co., Milwaukee, Wis.) or readily synthesizable organic esters are contemplated for use, and the combinations of esters are virtually limitless.

Although not shown, certain applications may require that frameless chair 10 be at least water resistant, if not, water impermeable. Several agents for creating a water impermeable bearer on material are commercially known and treatment of any and/or all of the components of frameless chair 10 are contemplated. For illustrative purposes only, such water impermeable agents include polymeric or long chain fluorocarbons and silane and siloxane based polymers. Of course, several other agents known to those having ordinary skill in the art are likewise contemplated for use.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A frameless chair, comprising:

an at least partially gas permeable outer liner comprising:

a first flexible end component having a substantially circular peripheral geometry;

a second flexible end component having a substantially circular peripheral geometry;

a flexible intermediate component having a substantially rectangular peripheral geometry, the first and second flexible end components being secured to the flexible intermediate component;

an at least partially gas permeable inner liner positioned within the outer liner comprising:

a first flexible end component having a substantially circular peripheral geometry;

a second flexible end component having a substantially circular peripheral geometry;

a flexible intermediate component having a substantially rectangular peripheral geometry, the first and second flexible end components being secured to the flexible intermediate component; and a plurality of polyurethane foam pieces retained within the inner liner.

2. The frameless chair according to claim 1, wherein the density of the polyurethane foam ranges from between approximately 1.0 and approximately 3.0 pounds per cubit foot.

3. The frameless chair according to claim 1, wherein the outer liner includes at least one seam having an outer surface and an inner surface, the outer surface of the seam being void of any exposed stitching.

* * * * *